United States Patent [19]

Blaisdell et al.

[11] 4,048,537

[45] Sept. 13, 1977

[54] PROTECTIVE ULTRAVIOLET-TRANSMITTING SLEEVE FOR FLUORESCENT LAMP

[75] Inventors: Ronald G. Blaisdell, Saugus; Harold L. Hough, Beverly; Robert E. Levin, Hamilton, all of Mass.

[73] Assignee: GTE Sylvania Incorporated, Salem, Mass.

[21] Appl. No.: 693,026

[22] Filed: June 4, 1976

[51] Int. Cl.[2] ..... H01J 61/40; H01J 61/42

[52] U.S. Cl. ..... 313/489; 313/112; 240/11.4 R

[58] Field of Search ..... 313/110, 112, 485, 489, 313/25; 240/11.4 R, 11.4 H; 526/19, 255; 350/1

[56] References Cited

U.S. PATENT DOCUMENTS

| | | | |
|---|---|---|---|
| 2,382,939 | 8/1945 | Koch | 313/25 X |
| 3,157,812 | 11/1964 | Friedman et al. | 350/1 X |
| 3,673,401 | 6/1972 | Du Pont | 240/11.4 R |
| 3,720,826 | 3/1973 | Gilmore et al. | 313/25 X |
| 3,787,382 | 1/1974 | Wright et al. | 526/255 |
| 3,798,481 | 3/1974 | Pollara | 313/110 |
| 3,808,495 | 4/1974 | Win | 313/110 |

*Primary Examiner*—Palmer C. Demeo
*Attorney, Agent, or Firm*—Edward J. Coleman

[57] ABSTRACT

A protective shield for an ultraviolet-emitting fluorescent lamp comprising a tubular sleeve coaxially surrounding the lamp envelope and formed of a plastic material, such as a fluorocarbon resin of a fluorinated ethylene-propylene, which has a spectral transmittance of at least about 80 percent of the ultraviolet radiation emitted from the lamp over the wavelength range from about 320 to 400 nanometers and substantially maintains such transmittance, along with mechanical integrity, after at least about 1000 hours of lamp operation.

21 Claims, 6 Drawing Figures

PROTECTIVE ULTRAVIOLET-TRANSMITTING SLEEVE FOR FLUORESCENT LAMP

BACKGROUND OF THE INVENTION

This invention relates to a light-transmitting shield for protecting ultraviolet-emitting lamps from casual impact and for retaining lamp fragments and debris should the frangible envelope lamp be broken.

The invention is particularly concerned with providing a protective shield for a fluorescent lamp having an elongated tubular glass envelope containing a low pressure ionizable medium. Breakage of the glass envelope of such a lamp can result in implosion with resulting violent scattering of fragments of glass and fluorescent powders, unless contained by a surrounding shield. Typically such shields for fluorescent lamps have comprised tubular sleeves of a polycarbonate, a UV absorbing acrylic or a styrene plastic, as described in U.S. Pat. No. 3,124,307 Hoskins et al, U.S. Pat. No. 3,673,401 DuPont, U.S. Pat. No. 3,720,826 Gilmore et al, U.S. Pat. No. 3,798,481 Pollara, and U.S. Pat. No. 3,808,495 Ulin. Although such prior art plastic materials may be quite satisfactory for conventional general lighting applications of fluorescent lamps, these materials have been found quite unsatisfactory for applications wherein the lamps are designed to emit a significant amount of ultraviolet radiation during normal operation.

For example, a copending application Ser. No. 693,029, filed concurrently herewith and assigned to the present assignee, describes a photochemotherapy chamber containing a plurality of special fluorescent lamps adapted for emitting long-wave ultraviolet light (UVA) in the region of 320 to 400 nanometers. Exposure to such radiation subsequent to oral administration of psoralens has been observed to artificially induce natural tanning of the skin of the human body. In view of clinical studies in this area, such therapy appears to have significant dermatological application with respect to the medical treatment of various skin disorders.

A critical component of the photochemotherapy procedure is, of course, the irradiation apparatus; it must safely provide the proper light radiation in an efficient yet carefully controlled manner. If extensive proportions of a person's body are to be irradiated and the individual is not bedridden, an upright enclosed chamber containing an array of lamps disposed to substantially surround a standing person with light is particularly useful in this application. For the protection of a person standing inside the chamber, each of the fluorescent tubes is enclosed in a protective plastic sleeve. Perferably there is a spacing between the glass tubing of the lamp and the enclosing sleeve, and the sleeve is retained by plastic end caps. In this manner, the lamps are protected from casual impact, and should the lamp be broken, the lamp fragments will be retained by the sleeve and end cap assembly. Of course, the plastic material of which the sleeve is formed should be of a type which efficiently transmits the UVA light and remains stable (i.e., will not discolor and disintegrate) under continued exposure thereto.

As previously mentioned, the prior art protective sleeve materials contend only with the heat and ultraviolet radiation from a standard fluorescent lamp used for general lighting applications. When these prior art protective sleeve materials were tested for use on lamps of the type intended for the above-described photochemotherapy chamber, however, it was found that the ultraviolet transmittance deteriorated rapidly under the UVA radiation. A typical example would be where a sleeve transmits 80% of the required radiation at the beginning of lamp life, but is reduced to about 40% after 400 hours operation. Usually the material yellows and begins to deteriorate physically at that point.

FIG. 1 shows a specific example of the spectral transmittance curves measured for a section of material taken from a prior art commercial lamp sleeve formed of polycarbonate. A Cary Spectral Photometer was used. One curve represents the initial transmittance, while the second curve shows the transmittance after 900 hours of exposure to 8 milliwatts per square centimeter of radiant energy in the ultraviolet wavelength range of between about 300 and 400 nanometers. It will be noted that the initial transmittance below 330 nanometers is poor, and with continued exposure, the transmittance decreases radically throughout the denoted ultraviolet range.

The lighting industry often uses plastics that are "UV stabilized" to prevent yellowing upon exposure to ultraviolet radiation. However, these stabilizers are UV blocking agents, and such stabilized plastics do not transmit appreciable ultraviolet radiation.

SUMMARY OF THE INVENTION

Accordingly, it is an object of the present invention to provide an improved protective shield for a lamp envelope which will contain the fragments and debris resulting from breakage while efficiently transmitting the ultraviolet radiation emitted from the lamp over the wavelength range from about 320 to 400 nanometers and withstanding the degrading effects of the ultraviolet radiation for extended periods of time.

A further object is to provide a lamp assembly having a tubular frangible envelope and a protective plastic sleeve covering the envelope, the sleeve being formed of a material which maintains a relatively high level of spectral transmittance to ultraviolet radiation emitted from the lamp, even after 1000 hours of normal operation.

These and other objects, advantages and features are attained in accordance with the invention, by employing a protective lamp shield which is formed of a plastic material having a spectral transmittance of at least about 80% of the ultraviolet radiation emitted from the lamp over the wavelength range from about 300 to 400 nanometers and which, after at least 1000 hours of normal operation of the lamp, maintains a transmittance of at least about 80% of that ultraviolet radiation and substantially maintains its mechanical integrity. In a preferred embodiment, a lamp assembly according to the invention comprises a fluorescent lamp having an elongated tubular glass envelope covered by a tubular plastic sleeve which is retained in a spaced-apart relationship with respect to the envelope by means of plastic end caps disposed at each end of the sleeve. Two plastic materials which have been found to be particularly suitable for making such a protective sleeve comprise a fluorocarbon resin of fluorinated ethylene-propylene or a copolymer of ethylene and tetrafluoroethylene.

With respect to the aforementioned photochemotherapy application, this sleeve material appears to provide a real breakthrough in providing a suitable UVA source with practical maintenance requirements.

BRIEF DESCRIPTION OF THE DRAWINGS

This invention will be more fully described hereinafter in conjunction with the accompanying drawings, in which.

DESCRIPTION OF PREFERRED EMBODIMENT

Figure 3:
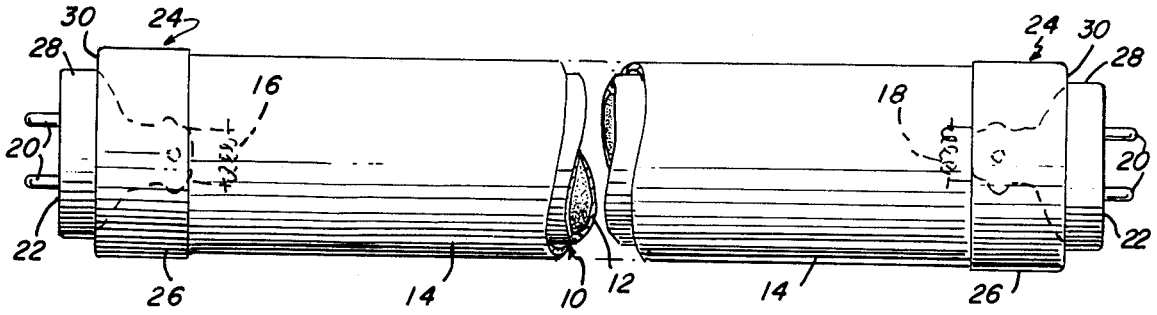
FIG. 3 is an elevation view of a lamp assembly according to the invention showing a protected fluorescent lamp tube fragmentarily.
Figure 4:
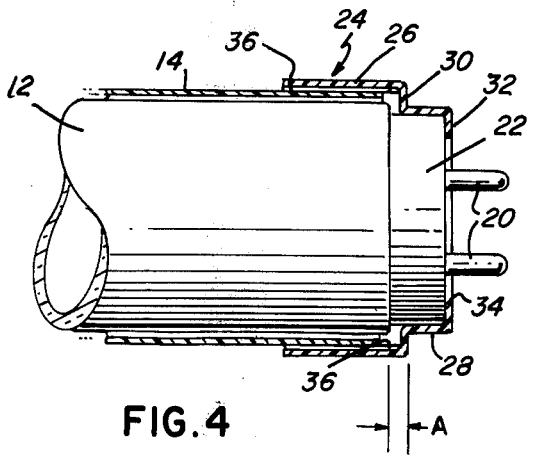
FIG. 4 is a fragmentary sectional elevation taken at the end of the assembly of FIG. 3.

The lamp assembly shown in FIGS. 3 and 4 comprises a fluorescent lamp 10 having an elongated tubular glass envelope 12 with base members 22 secured at each end. The glass envelope 12 is protectively covered by a tubular plastic sleeve 14 which is retained in a spaced-apart telescoped relationship with the envelope 12 by a pair of plastic end caps 24 disposed at each end of the sleeve.

The lamp 10 contains an ionizable medium consisting of a suitable starting gas, such as neon or a mixture of neon and argon at low pressure, and a predetermined amount of mecury. A pair of spaced electrodes 16 and 18 are sealed into respective ends of the envelope 12 and are electrically connected to pin terminals 20 secured in the base members 22. The energized electrodes, in conjunction with the mercury and gas fill, initiate and sustain an electric discharge within the lamp 10 which excites a layer of phosphor coated on the inner surface of the envelope in the well known manner.

As illustrated, sleeve 14 is shorter than the overall length of the lamp 10 but is substantially the same or slightly less than the length of the glass envelope 12. The inside diameter of the tubular sleeve 14 is slightly larger than the outside diameter of the envelope 12 so as to provide an annular air space along almost the entire length of the envelope.

Figure 5:
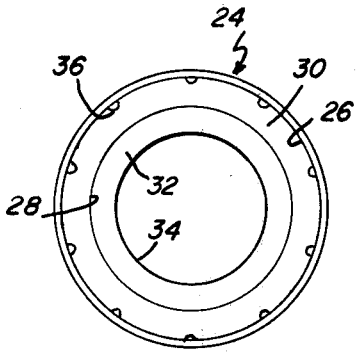
FIG. 5 is an axial view of the end cap employed in FIGS. 3 and 4 to retain the protective sleeve at each end of the lamp; and, FIG. 6 is a fragmentary sectional elevation showing an alternative lamp base.

Referring also to FIG. 5, each end cap 24, which may be an integrated molded piece, comprises a first cylindrical portion 26 and a lesser cylindrical portion 28. Each cylindrical portion is hollow. A transverse annular wall 30 connects the two cylindrical portions. A second wall 32 remote from the cylinder 26 is an end stop that impinges upon the circular end face of base member 22. An opening defined by a circular periphery 34 in wall 32 of each end cap affords passage to the pin terminals 20 of the base members. A plurality of equally spaced axial beads, or ribs 36 protrude inwardly from the inner surface of the cylindrical portion 26 and substantially extend the axial length thereof.

Referring to FIG. 4, the end cap 24 at each end of the lamp is engaged about the respective base member 22 thereat such that the second annular wall 32 and the smaller cylindrical portion 28 tightly grip the base member. Annular wall 30 extends outwardly from portion 28 and supports the larger cylindrical portion 26 at a spaced interval from the envelope 12 of the flurorescent lamp. The cylindrical portion 26 fits about the respective end of plastic sleeve 14 with the axial ribs 36 providing a sliding grip about the periphery thereof. The sleeve 14 is thus supported by the end caps 24 in the desired coaxially spaced-apart relationship with respect to the lamp envelope 12. In addition to the radial clearance between the sleeve and envelope, there is also a clearance A between each end of the sleeve and transverse wall 30 of the respective end cap, both of these clearances allowing for thermal expansion of the plastic sleeve.

Figure 6:
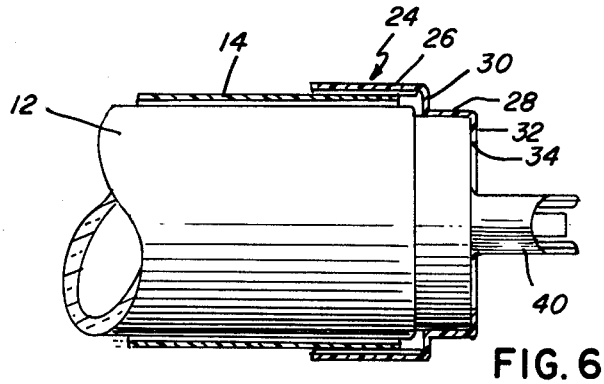

FIG. 6 shows an alternative base configuration for the sleeved lamp which is particularly useful in the previously referenced photochemotherapy application. In this instance, the lamp envelope 12 is terminated at each end with a shrouded single-pin base 40 of the type employed on "SIGNLINE" lamps available from GTE Sylvania Incorporated. Such a base is particularly effective in providing proper orientation of the lamp without accidental rotation due to vibration. The sleeve 14 and end caps 24 are mounted as previously described with respect to the lamp of FIGS. 3 and 4.

In accordance with the invention, the protective plastic sleeve 14 is made from a specific material which (a) will transmit ultraviolet radiation at least above 320 nanometers but often above 250 nanometers, (b) will have minimal loss of transmittance when exposed to ultraviolet radiation above 290 nanometers, (c) will have minimal loss of mechanical strength when exposed to the same radiation, and (d) will withstand service tempertures, up to 400° F. A preferred material for sleeve 14 is extruded tubing of "Teflon" FEP-Flurocarbon resin ("Teflon" being a trademark of E. I. du Pont de Nemours Co.). This is a relatively clear fluorocarbon resin of fluorinated ethylene-propylene which is a copolymer made from tetrafluoroethylene and hexafluoroproplylene. The wall thickness of the tubing may range from about 0.010 to 0.040 inch. This material was found to be a most suitable plastic for use in the environment described and provided the toughness and flexibility to assure adequate protection to individuals against broken lamps. This material was selected after tests and experiments were performed on many different plastics. Use of this material as an ultraviolet-transmitting lamp sleeve was totally unexpected as such an application appears to have never been contemplated by the suppliers of such tubing.

Figure 1:
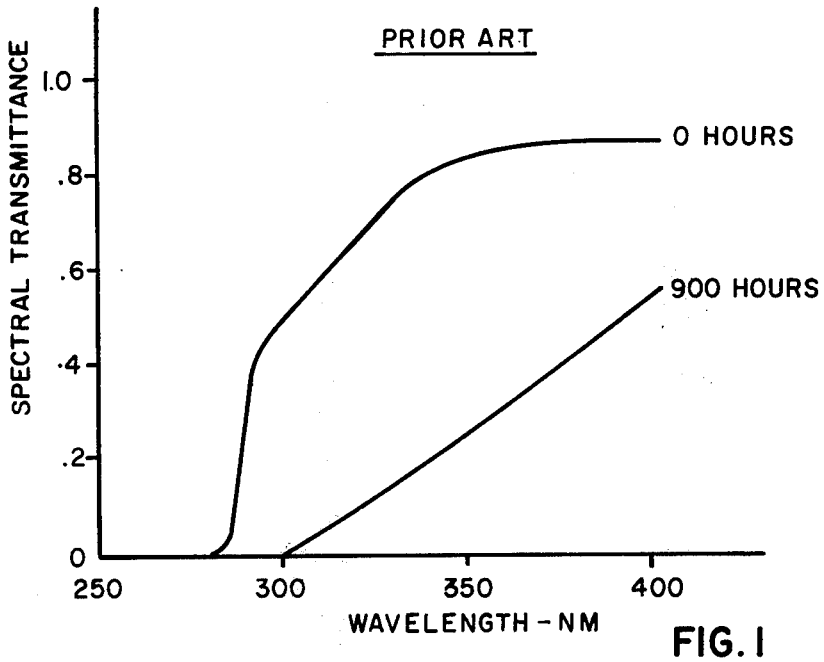
FIG. 1 shows spectral transmittance curves for a prior art protective sleeve material to which previous reference has been made.
Figure 2:
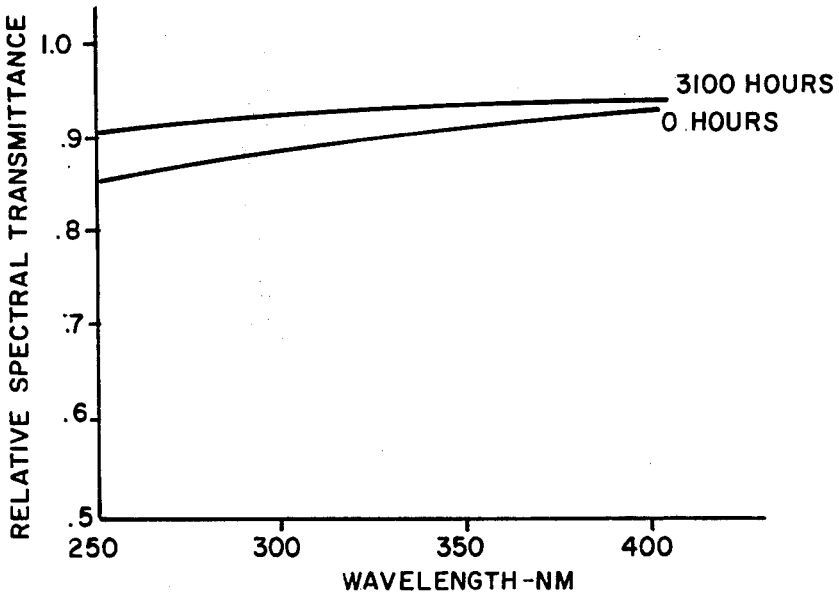
FIG. 2 shows relative spectral transmittance curves for protective lamp sleeves formed of a plastic material in accordance with the invention.

FIG. 2 shows a specific example of the relative spectral transmittance curves measured for sections of material taken from the above-described "Tefflon" FEP tubing. A Cary Spectral Photometer was used. One curve represents the initial relative transmittance, while the second curve shows the relative transmittance after 3100 hours of exposure to 8 milliwatts per square centimeter of radiant energy in the ultraviolet wavelength range between about 300 and 400 nanometers. Note the material was found to transmit wavelengths as short as 250 nanometers both before and after this aging. As the samples were slightly translucent and thereby caused light scattering, these curves are not absolute. However, measurements of total radiant transmittance in the 320 to 380 nanometer band by using a UV radiometer (International Light, Inc.) indicate the absolute transmittance is about 90 percent.

An alternative to the use of "Teflon" FEP would be to employ another transparent fluorocarbon, such as "Tefzel" ETFE, which is a copolymer of ethylene and tetrafluoroethylene available from E. I. du Pont de Nemours Co.

The end caps 24 do not have to transmit ultraviolet radiation; hence, any suitable UV-stable material may be used, such as polypropylene or a fluorocarbon.

According to one specific embodiment of the invention, lamp 10 comprised a fluorescent tube type FR83T12 PUVA available from GTE Sylvania Incorporated. Thus, the tubular lamp had a length of about 83 inches nd a diameter of about 1½ inches. The lamp 10 contained a 235° internal reflector and had shrouded single-in bases 40 (FIG. 6) to provide proper orientation without accidental rotation due to vibration. The enclosing plastic sleeve 14 was an extruded tube of "Teflon" FEP 160 having a specified length of 80.250 – 80.370 inches, an outside diameter of 1.655 – 1.670 inches and a wall thickness of 0.025 – 0.032 inch. The end caps 24 were integral molded pieces formed of polyporpylene. Clearance A (FIG. 4) was specified as from 0.050 to 0.210 inch.

Although the invention has been described with respect to a specific embodiment, it will be appreciated that modifications may be made by those skilled in the art without departing from the true spirit and scope of the invention. For example, the protective shield may take other forms than that of a sleeve about a tubular lamp; e.g., in the aforementioned photochemotherapy chamber the shield may comprise a flexible or rigid sheet of plastic material, in accordance with the invention, which is supported in substantially adjacent relationship to one or a plurality of the lamps mounted in the chamber. Thus, each chamber wall assembly would contain a plurality of UV emitting fluorescent lamps and have one or more interior wall surfaces comprising sheets of the plastic material claimed herein for providing a protective shield between the lamps and a person inside the chamber. The aforementioned "Teflon" material is better suited for this application as extruded tubing rather than in sheet form. However, a material which has been found to be particularly suited to sheet form, rather than as a sleeve of tubing, is UV transmitting acrylic having a thickness of about ⅛ inch, such as Rohm and Haas' plexiglass II UVT" (MIL-P-5425C, Finish A).

What is claimed is:

1. A lamp assembly comprising, in combination:
an electric lamp having a frangible envelope and adapted for emitting a significant amount of ultraviolet radiation during normal operation;
a protective shield for said lamp disposed in substantially adjacent relationship with said envelope and formed of a plastic material comprising a fluorocarbon resin having a wall thickness in the range of about 0.010 to 0.040 inch which has a spectral transmittance of at least about 80% of the ultraviolet radiation emitted from said lamp over the wavelength range from about 320 to 400 nanometers and, after at least 100 hours of normal operation of said lamp, maintains a transmittance of at least about 80% of said ultraviolet radiation and substantially maintains its mechanical integrity; and,
means for retaining said shield in the aforesaid relationship with said envelope.

2. The lamp assembly of claim 1 wherein the transmitted ultraviolet wavelength range is from about 290 to 400 nanometers.

3. The lamp assembly of claim 2 wherein the transmitted ultraviolet wavelength range is from about 250 to 400 nanometers.

4. The lamp assembly of claim 1 wherein said transmittance of at least about 80% over the range from 320 to 400 nanometers is maintained after at least 3000 hours of operation of said lamp.

5. The lamp assembly of claim 1 wherein said protective shield is retained in a spaced-apart relationship with said lamp envelope.

6. The lamp assembly of claim 1 wherein said plastic material comprises a fluorocarbon resin of fluorinated ethylene-propylene or a copolymer of ethylene and tetrafluoethylene.

7. The lamp assembly of claim 6 wherein said plastic material comprises a fluorocarbon resin of fluorinated ethylene-propylene 8. The lamp assembly of claim 1 wherein said protective shield comprises a plastic sleeve covering said lamp envelope.

9. The lamp assembly of claim 8 wherein said plastic sleeve is retained in a spaced-apart relationship with said lamp envelope whereby the inner surface of the sleeve is spaced from the outer surface of the envelope.

10. The lamp assembly of claim 9 wherein said lamp is a fluorescent lamp having an elongated tubular glass envelope containing a low pressure ionizable medium and a pair of spaced electrodes which are connected to terminals that are located at respective ends of the lamp envelope and are secured in base members fastened to the ends of the envelope, and said plastic sleeves is of tubular shape having a length which is substantialy the same or slightly less than the length of said envelope and an outside diameter which is larger than the outside diameter of said envelope.

11. The lamp assembly of claim 10 wherein said means for retaining said plastic sleeve comprises a plastic end cap disposed at each end of said sleeve, each end cap having a first cylindrical portion fitting about a respective end of said sleeve for holding said sleeve in a coaxially spaced-apart relationship with respect to said lamp envelope, a second cylindrical portion of lesser diameter adapted to grip a respective base member of said lamp, and a transverse annular wall joining the two portions.

12. A protective shield for an ultraviolet-emitting lamp having a tubular glass envelope, said shield comprising a tubular sleeve adapted to coaxially surround said lamp envelope and formed of a plastic material comprisng a fluorocarbon resin having a wall thickness in the range of about 0.010 to 0.040 inch which has a spectral transmittance of at least about 80% of the ultraviolet radiation emitted from said lamp over the wavelength range from 320 to 400 nanometers and, after exposure to at least 1000 hours of normal operation of said lamp, maintains a transmittance of at least about 80% of said ultraviolet radiation and substantially maintains its mechanical integrity.

13. The shield of claim 12 wherein the transmitted ultraviolet wavelength range is from about 290 to 400 nanometers.

14. The shield of claim 13 wherein the transmitted ultraviolet wavelength range is from about 250 to 400 nanometers.

15. The shield of claim 12 wherein said transmittance of at least about 80% over the range from 320 to 400 nanometers is maintained after exposure to at least 3000 hours of operation of said lamp.

16. The shield of claim 12 wherein said plastic material comprises a fluorocarbon resin of fluorinated ethylene-propylene or a copolymer of ethylene and tetrafluoroethylene.

17. The shield of claim 16 wherein said plastic material comprises a fluorocarbon resin of fluorinated ethylene-propylene.

18. The shield of claim 17 wherein said plastic sleeve is extruded.

19. The shield of claim 12 further including means assembled to said tubular sleeve for retaining said sleeve in a spaced-apart relationship with said lamp envelope.

20. The shield of claim 19 wherein said lamp is a fluorescent lamp having an elongated tubular glass envelope containing a low pressure ionizable medium and a pair of spaced electrodes which are connected to terminals that are located at respective ends of the lamp envelope and are secured to base members fastened to the ends of the envelope, and said tubular sleeve is formed of a plastic material which has sufficient mechanical integrity, after exposure to at least 3000 hours of operation of said lamp, to contain an implosion of said lamp.

21. The shield of claim 20 wherein said means for retaining said plastic sleeve comprises a plastic end cap disposed at each end of said sleeve, each end cap having a first cylindrical portion fitting about a respective end of said sleeve for holding said sleeve in a coaxially spaced-apart relationship with respect to said lamp envelope, a second cylindrical portion of lesser diameter adapted to grip a respective base member of said lamp, and a transverse annular wall joining the two portions.

* * * * *

UNITED STATES PATENT AND TRADEMARK OFFICE

CERTIFICATE OF CORRECTION

PATENT NO. : 4,048,537

DATED : SEPTEMBER 13, 1977

INVENTOR(S) : RONALD G. BLAISDELL, HAROLD L. HOUGH, ROBERT E. LEVIN

It is certified that error appears in the above-identified patent and that said Letters Patent are hereby corrected as shown below:

IN THE CLAIMS

Claim 1, column 5, line 60 (100) should be (-1000-).

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*